US010974930B2

(12) United States Patent
Liu

(10) Patent No.: US 10,974,930 B2
(45) Date of Patent: Apr. 13, 2021

(54) TRACTION SHEAVE, PULLEY COMPONENT AND ELEVATOR HAVING SAME

(71) Applicant: Otis Elevator Company, Farmington, CT (US)

(72) Inventor: Ruguang Liu, Tianjin (CN)

(73) Assignee: OTIS ELEVATOR COMPANY, Farmington, CT (US)

( * ) Notice: Subject to any disclaimer, the term of this patent is extended or adjusted under 35 U.S.C. 154(b) by 360 days.

(21) Appl. No.: 15/772,976

(22) PCT Filed: Nov. 3, 2016

(86) PCT No.: PCT/US2016/060229

§ 371 (c)(1),
(2) Date: May 2, 2018

(87) PCT Pub. No.: WO2017/079371

PCT Pub. Date: May 11, 2017

(65) Prior Publication Data

US 2020/0262684 A1 Aug. 20, 2020

(30) Foreign Application Priority Data

Nov. 5, 2015 (CN) ..... 2015 2 0874908 U

(51) Int. Cl.
*B66B 15/00* (2006.01)
*B66B 15/04* (2006.01)
*B66B 11/08* (2006.01)

(52) U.S. Cl.
CPC ..... *B66B 15/04* (2013.01); *B66B 11/08* (2013.01)

(58) Field of Classification Search
CPC .... B66D 2700/026; B66B 15/04; B66B 11/08
(Continued)

(56) References Cited

U.S. PATENT DOCUMENTS 986,712 A 3/1911 Hipp
1,469,828 A 10/1923 Smith
(Continued)

FOREIGN PATENT DOCUMENTS

CN 201890691 U 7/2011
CN 102849581 A 1/2013
(Continued)

OTHER PUBLICATIONS

International Search Report and Written Opinion for application PCT/US2016/060229, dated Jun. 7, 2017, 9 pages.

*Primary Examiner* — Emmanuel M Marcelo
(74) *Attorney, Agent, or Firm* — Cantor Colburn LLP

(57) ABSTRACT

The present utility model provides a traction sheave, including: a traction sheave body, formed of several arc-shaped traction sheave sections that are connected to each other; and connecting portions, disposed at two ends of each traction sheave section along a lateral surface of the traction sheave section, where the connecting portions at the two ends of each traction sheave section fit each other. The traction sheave according to the present utility model has relatively high replaceability, is very convenient to assemble and disassemble, requires relatively low costs of human and material resources and time, and meanwhile can still ensure high reliability of working of the traction sheave.

23 Claims, 8 Drawing Sheets

(58) Field of Classification Search
USPC ..... 254/278, 393
See application file for complete search history.

(56) References Cited

U.S. PATENT DOCUMENTS

| | | | | |
|---|---|---|---|---|
| 1,636,492 | A | 7/1927 | Taylor | |
| 1,959,570 | A * | 5/1934 | Chevalier | B65H 75/20 474/195 |
| 3,354,735 | A | 11/1967 | Holz | |
| 4,030,569 | A | 6/1977 | Berkovitz | |
| 4,284,409 | A | 8/1981 | Van Teslaar | |
| 4,439,173 | A | 3/1984 | Fokos | |
| 4,465,161 | A | 8/1984 | Ohta et al. | |
| 5,829,736 | A * | 11/1998 | Harken | B66D 1/7431 254/278 |
| 6,755,393 | B2 | 6/2004 | Yamasaki | |
| 7,353,913 | B2 | 4/2008 | Hashiguchi | |
| 7,644,907 | B2 * | 1/2010 | Ives | B65H 75/14 242/613 |
| 7,662,058 | B2 * | 2/2010 | Marten-Perolino | B61B 12/10 474/166 |
| 8,132,789 | B2 | 3/2012 | Graebner | |
| 8,152,140 | B1 * | 4/2012 | Ouellette | B66D 1/34 242/579 |
| 8,888,072 | B1 * | 11/2014 | Orgeron | B66D 3/046 254/393 |
| 2003/0040386 | A1 | 2/2003 | Yamasaki | |
| 2005/0216097 | A1 * | 9/2005 | Rifkin | A61F 2/60 623/53 |
| 2006/0163550 | A1 * | 7/2006 | Hafele | F16H 55/50 254/393 |

FOREIGN PATENT DOCUMENTS

| | | | |
|---|---|---|---|
| CN | 102849582 | A | 1/2013 |
| CN | 202766052 | U | 3/2013 |
| CN | 203845732 | U | 9/2014 |
| CN | 104781176 | A | 7/2015 |
| FR | 2505961 | A1 | 11/1982 |
| GB | 2127934 | A | 4/1984 |
| JP | S5815435 | B2 | 3/1983 |

* cited by examiner

TRACTION SHEAVE, PULLEY COMPONENT AND ELEVATOR HAVING SAME

TECHNICAL FIELD

The present utility model relates to the field of elevators, and more specifically, the present utility model relates to a pulley component of an elevator.

BACKGROUND

An elevator is a transport tool frequently used in daily life. However, because of a special use scenario of an elevator, the elevator needs maintenance for a long period, and aged or worn parts need to be replaced at an appropriate time, so as to ensure safety of application of the elevator. At present, according to usage of an elevator, a pulley component of the elevator is generally replaced about every 6 years. However, it is found in actual maintenance processes that it is very difficult to maintain and replace a pulley component at a site of mounting and using an elevator. After a maintenance person turns off an elevator, a conveyor belt or a conveyor rope tensioned on a traction sheave of a pulley component still needs to be completely pulled away. Throughout a process of maintaining and replacing a traction sheave, such an action of pulling away the conveyor belt or the conveyor rope needs to be kept, and after replacement of the traction sheave is completed, the conveyor belt is tensioned on the traction sheave again. Moreover, throughout a process of maintenance, a conveyor belt needs to be taken off first, and is mounted again after the maintenance is completed. Therefore, regardless of which manner is used, this replacement process consumes a large amount of human and material resources. Meanwhile, the process further has a high cost of time, resulting in that a user needs to wait for a long time, which reduces user experience.

To improve such a condition, experts in the field also propose a concept of changing a complete traction sheave into multiple sections to overcome the foregoing problem. However, to apply such a concept to an actual scenario, multiple issues further need to be considered. For example, an issue is how to connect these sections to facilitate replacement of the sections without affecting normal working of a traction sheave. For another example, an issue is how to design angles and perimeters of these sections to achieve the foregoing effect.

SUMMARY

An objective of the present utility model is to provide a traction sheave that has higher efficiency and can keep its own structural reliability when maintenance and replacement are required.

An objective of the present utility model is further to provide a pulley component that can adapt to the traction sheave according to the present utility model, thereby facilitating maintenance.

An objective of the present utility model is further to provide an elevator that has the pulley component of the present utility model, thereby facilitating maintenance.

To achieve the foregoing objectives or other objectives, the present utility model provides the following technical solutions.

According to an aspect of the present utility model, a traction sheave is provided, including: a traction sheave body, formed of several arc-shaped traction sheave sections that are connected to each other; and connecting portions, disposed at two ends of each traction sheave section along a lateral surface of the traction sheave section, wherein the connecting portions at the two ends of each traction sheave section fit each other.

According to another aspect of the present utility model, a pulley component is further provided, including: the foregoing traction sheave; a pulley, including a pulley body and a shaft located on a side of the pulley body, the traction sheave being sleeved over the shaft of the pulley; and a conveyor belt, tensioned with a part of the traction sheave.

According to still another aspect of the present utility model, an elevator is further provided, including: the foregoing pulley component.

DETAILED DESCRIPTION OF EMBODIMENTS

Figure 1:
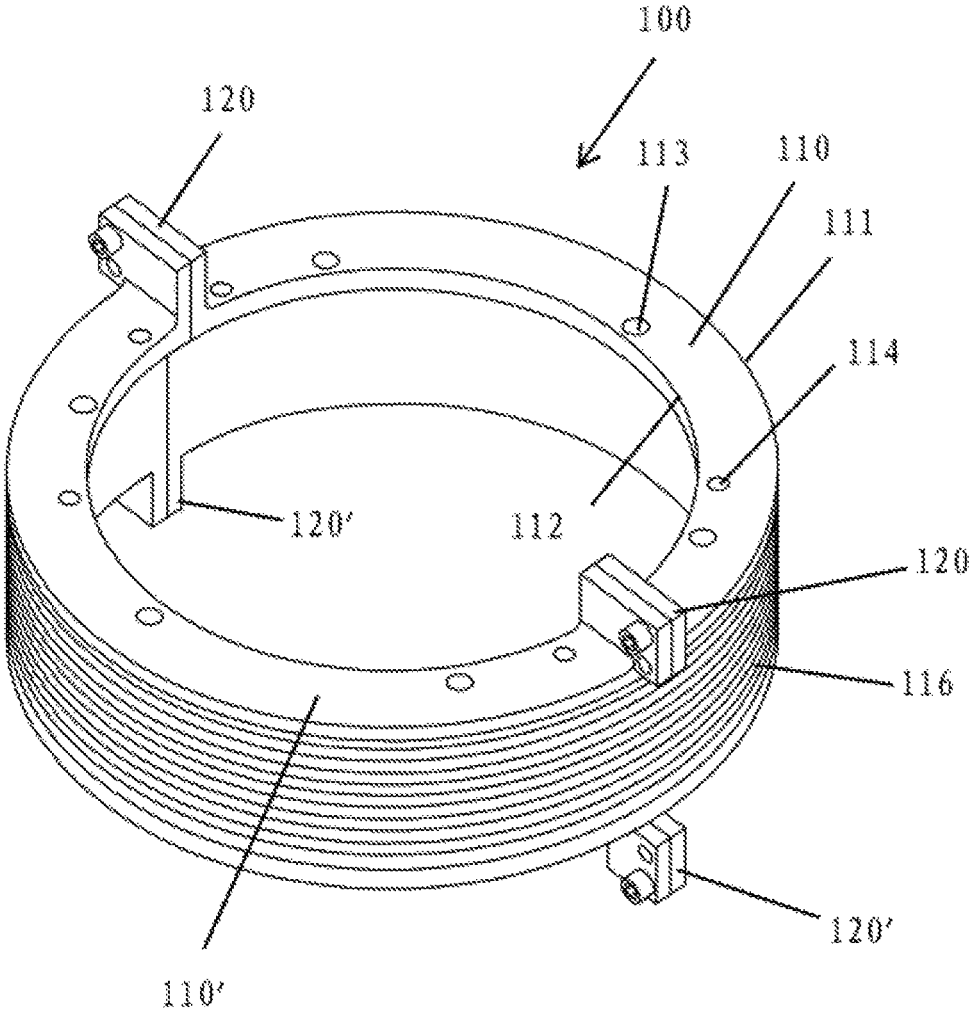
FIG. 1 is a schematic structural diagram of a traction sheave according to an embodiment of the present utility model.
Figure 2:
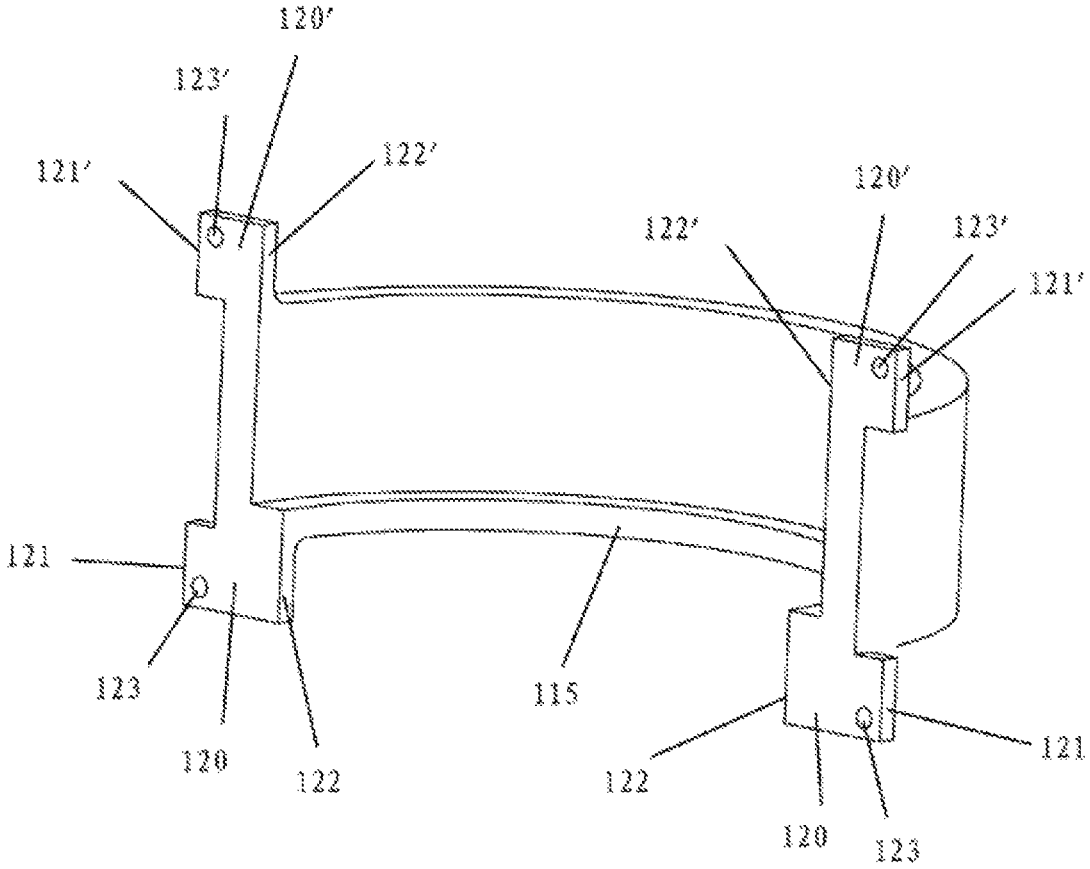
FIG. 2 is a schematic structural diagram of a traction sheave section according to an embodiment of the present utility model.

Referring to FIG. 1 and FIG. 2, a first embodiment of a traction sheave of the present utility model is shown. A traction sheave 100 in FIG. 1 and FIG. 2 includes a traction sheave body, having a basically circular outline, a conveyor belt groove 116 being disposed on an outer-circumference of the traction sheave body, to implement engagement with a conveyor belt, thereby achieving an effect of torque transfer. In this embodiment, the traction sheave body is formed of two arc-shaped traction sheave sections 110, 110'. Connecting lugs 120, 120' are disposed respectively at two ends of each traction sheave section 110, 110'. The connecting portions 120, 120' may be respectively placed on two opposite lateral surfaces of the traction sheave sections 110, 110', so that two sides of the traction sheave sections 110, 110' fit each other, so as to connect the traction sheave sections 110, 110' into a complete traction sheave body.

Specifically, the connecting lugs 120 are respectively located on edges of two end portions of the traction sheave section 110. In an aspect, the connecting lugs 120 extend upwards/downwards perpendicular to lateral surfaces on two sides of the traction sheave section 110. In another aspect, a first end 122 of the connecting lug 120 extends inwards in a horizontal direction to be flush with an inner circumference 112 of the traction sheave section 110. A second end 121 of the connecting lug 120 extends outwards to protrude from an outer circumference 111 of the traction sheave section 110, so as to form a rectangular sheet-form structure. A first connecting hole 123 for providing stable connection is provided on a side, away from the traction sheave section 110, of the rectangular sheet-form second end 121 of the connecting lug 120. The other connecting lug 120' also has the foregoing structure. Therefore, during assembly, the connecting lugs 120 at two ends of the traction sheave section 110 may be respectively aligned with the connecting lugs 120' at two ends of the traction sheave section 110', and first connecting bolts 124 pass through corresponding connecting holes 123, 123' to achieve an effect of fastening the traction sheave sections 110, 110'. Fastening of a traction sheave section in a circumferential direction is actually implemented.

In addition, second connecting holes 113 and positioning holes 114 are further disposed on the lateral surfaces of the traction sheave section 110. The second connecting holes 113 are uniformly provided near the inner circumference 112 of the traction sheave section 110, so as to provide reliable connection between the traction sheave section 110 and a pulley body. The positioning holes 114 similarly are uniformly provided near the inner circumference 112 of the traction sheave section 110, so as to implement reliable relative positioning between the traction sheave section 110 and the pulley body. The foregoing arrangement also exists in the traction sheave section 110'. Fastening in an axial direction of a traction sheave section is actually implemented. This is further described below with reference to an embodiment of the pulley component of the present utility model.

Still referring to FIG. 2, the traction sheave 100 in this embodiment further includes a flange 115 on a side of the traction sheave 100. The flange 115 protrudes inwards along the entire inner circumferences 112 of the traction sheave sections 110, 110', so as to provide position limiting of the traction sheave sections 110, 110' relative to a shaft of the pulley component. In this case, the second connecting holes 113 may be disposed on the flange, to implement reliable relative positioning between the traction sheave section 110 and the pulley body.

Although an embodiment of the present utility model is described above with reference to FIG. 1 and FIG. 2, a person skilled in the art should know that several technical measures in the embodiment have multiple alternative implementation manners, and therefore, the protection scope of this application should be considered based on the appended claims, and is not limited to this single embodiment.

Multiple alternative embodiments of the traction sheave section are further provided herein for reference.

Optionally, the traction sheave body in the foregoing embodiment is formed of two traction sheave sections 110, 110' that are connected. However, this is considered and designed mainly to improve the working reliability of a traction sheave. When reliability requirement in an actual application environment is relatively low, the traction sheave body may also be designed to be formed of more than two traction sheave sections, and an effect of facilitating replacement and maintenance that is needed by the present utility model can also be achieved.

Optionally, in the foregoing embodiment, the two traction sheave sections 110 that form the traction sheave body are completely symmetrical. However, this is considered mainly to facilitate processing and molding and improve universality of parts. For example, in this case, traction sheave sections in only one structural form need to be fabricated. When any traction sheave section is worn, a same part may be used for replacement. Based on the same consideration, when the traction sheave body is formed of multiple traction sheave sections 110, each section may also be completely symmetrical. Meanwhile, when this aspect does not need to be considered, two traction sheave sections or several traction sheave sections of the traction sheave body may not use an identical structural form. For example, the traction sheave sections may have different angles or different arc lengths.

In addition, to facilitate assembly and disassembly, a further structural design requirement may further be imposed for the traction sheave section of the present utility model.

For example, when the traction sheave body of the present utility model is formed of two traction sheave sections, an angle of any one traction sheave section may be greater than a first angle, and the first angle is between 147° and 165° in this embodiment. The first angle is designed to mainly avoid friction or collision between the traction sheave section and the conveyor belt in a process of assembling and disassembling the traction sheave section. Therefore, preferably, if an angle of any of traction sheave sections is greater than a wrap angle of the conveyor belt (corresponding to the first angle herein), the foregoing problem can be effectively avoided. Meanwhile, optionally, when a traction sheave is designed to be noncircular based on an application environment of the traction sheave, it is not very suitable to describe a shape of a traction sheave section by using an angle. In this case, it may be designed that an outer-circumferential perimeter of any one of the traction sheave sections is greater than a first length, and a ratio of the first length to a total perimeter of the traction sheave is kept between 0.4 and 0.46. In this way, friction or collision between the traction sheave section and the conveyor belt can also be avoided.

For another example, when the traction sheave body of the present utility model is formed of more than two traction sheave sections, an angle of any one of the traction sheave sections may be less than a second angle, and the second angle is between 195° and 213°. Meanwhile, optionally, an outer-circumferential perimeter of any one of the traction sheave sections may be less than a second length, and a ratio of the second length to a total perimeter of the traction sheave is between 0.54 and 0.6. In this way, friction or collision between the traction sheave section and the conveyor belt can also be avoided.

Multiple alternative embodiments of the connecting portion are further provided herein for reference.

Optionally, in the foregoing embodiment, the connecting lug 120 is used for connection between the traction sheave sections. However, the foregoing embodiment is relatively a preferred embodiment, and has advantages such as convenient processing and secure connection. Other connection structures may also be used. For example, two connecting portions having wedge-form structures that fit each other, or two connecting portions having buckles that fit each other.

Optionally, to provide a relatively secure connection effect, in the first embodiment of the present utility model, connecting lugs are respectively disposed on both lateral surfaces of a traction sheave section. In an actual application, a connecting lug may also be disposed on only one side of a traction sheave section.

Similarly, an extending length of a connecting lug and a specific design location of a first connecting hole on the connecting lug may also be changed according to an actual case.

Optionally, in the first embodiment of the present utility model, the second connecting holes and/or positioning holes are uniformly disposed in a circumferential direction on lateral surfaces of each traction sheave section. However, in an actual application, the second connecting holes and/or positioning holes may not need to be uniformly disposed in a circumferential direction on the lateral surfaces of each traction sheave section.

Figure 8:
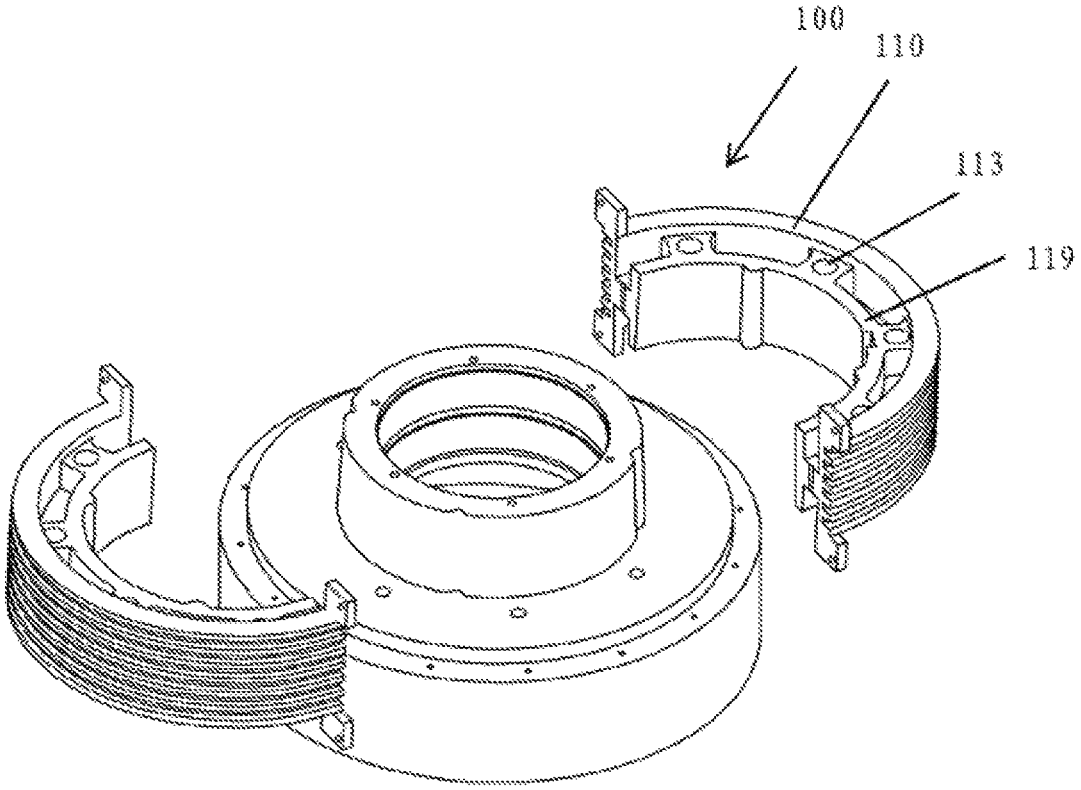
FIG. 8 is a schematic structural diagram of a traction sheave and a pulley component according to another embodiment of the present utility model.

In addition, referring to FIG. 8, another embodiment of a traction sheave and a pulley component of the present utility model is shown. In this case, a boss 119 is disposed along an inner circumference of each traction sheave section 110, and several second connecting holes 113 and/or positioning holes (not shown) are disposed in a circumferential direction on a lateral surface of the boss 119. Optionally, these second connecting holes 113 and/or positioning holes are uniformly disposed in a circumferential direction on the boss 119.

It should be known that various embodiments of the connecting portion and various embodiments of the traction sheave section that are additionally described above may be arbitrarily combined and applied in the first embodiment described above in detail.

Figure 3:
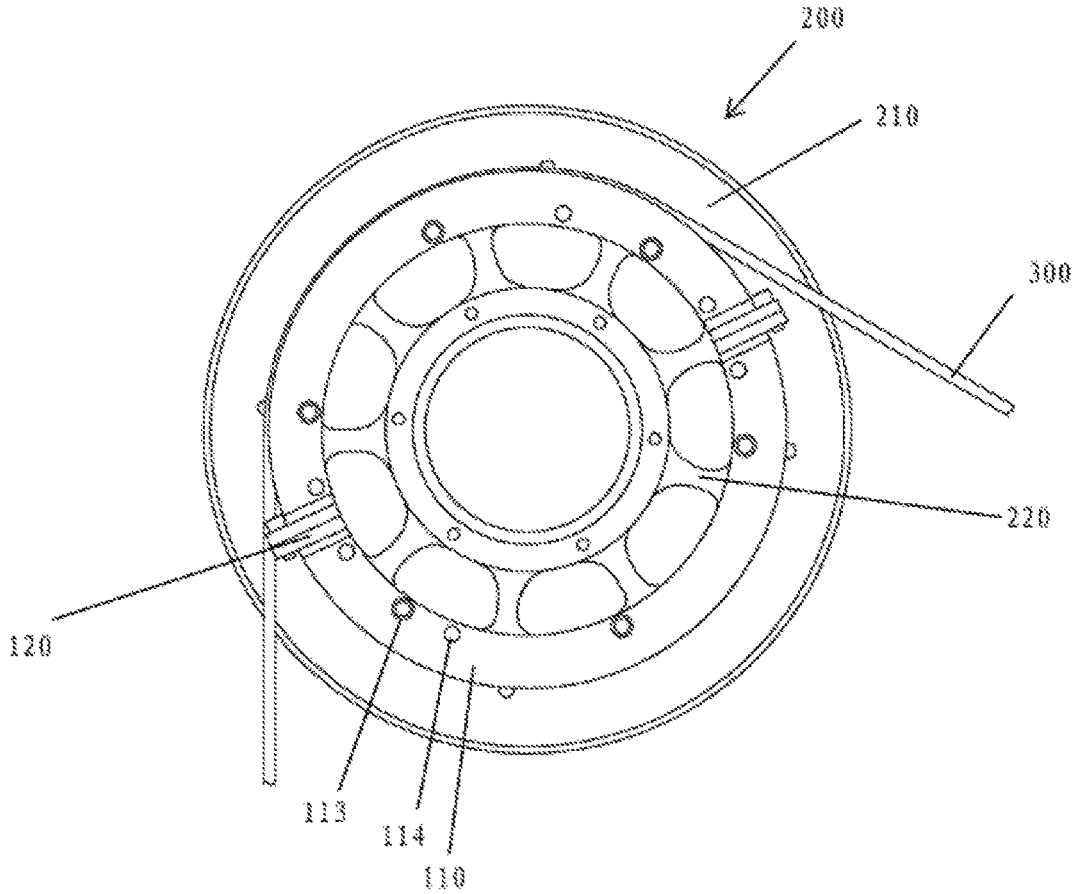
FIG. 3 is a schematic structural diagram of a pulley component according to an embodiment of the present utility model.

Referring to FIG. 3, one embodiment of the pulley component 200 of the present utility model is shown. The pulley component has any traction sheave in the foregoing. In addition, to fit such a traction sheave, the pulley component 200 further has a pulley. The pulley includes a pulley body 210 and a shaft 220 located on a side of the pulley body 210. The traction sheave is sleeved over the shaft 220 of the pulley. The pulley component further includes a conveyor belt 300. During operation, the conveyor belt 300 is tensioned with a part of the traction sheave, and transfers torque along with rotation of the traction sheave.

Because the traction sheave may rotate, any one of the traction sheave sections 110 that form the traction sheave and the conveyor belt 300 have a contact location and a separate location. As shown in FIG. 3, the traction sheave section 110 and the conveyor belt 300 are at the separate location. In this case, the connecting portion 120 may be loosened, and then the traction sheave section 110 may be detached. Specific processes of assembly and disassembly are specifically described below.

It should be noted that, after mounting of the pulley component is completed, the conveyor belt 300 forms a wrap angle relative to the traction sheave. An angle of any one of the traction sheave sections 110 is less than a difference value between 360° and a value of the wrap angle. More specifically, in this embodiment, the wrap angle is between 147° and 165°. As shown in FIG. 3, such design enables the traction sheave section 110 to be completely removed from a tensioning area between the conveyor belt 300 and the traction sheave when the traction sheave section 110 rotates by a certain angle, so that in a process of detaching the traction sheave section 110, no collision occurs between the traction sheave section 110 and the conveyor belt 300.

Optionally, by using a fastener that passes through a lateral surface of the traction sheave and a lateral surface of the pulley body, the traction sheave and the pulley body may be connected and secured. This connection manner can ensure connection reliability and a securing degree, and causes no inconvenience to a detaching process.

Figure 4:
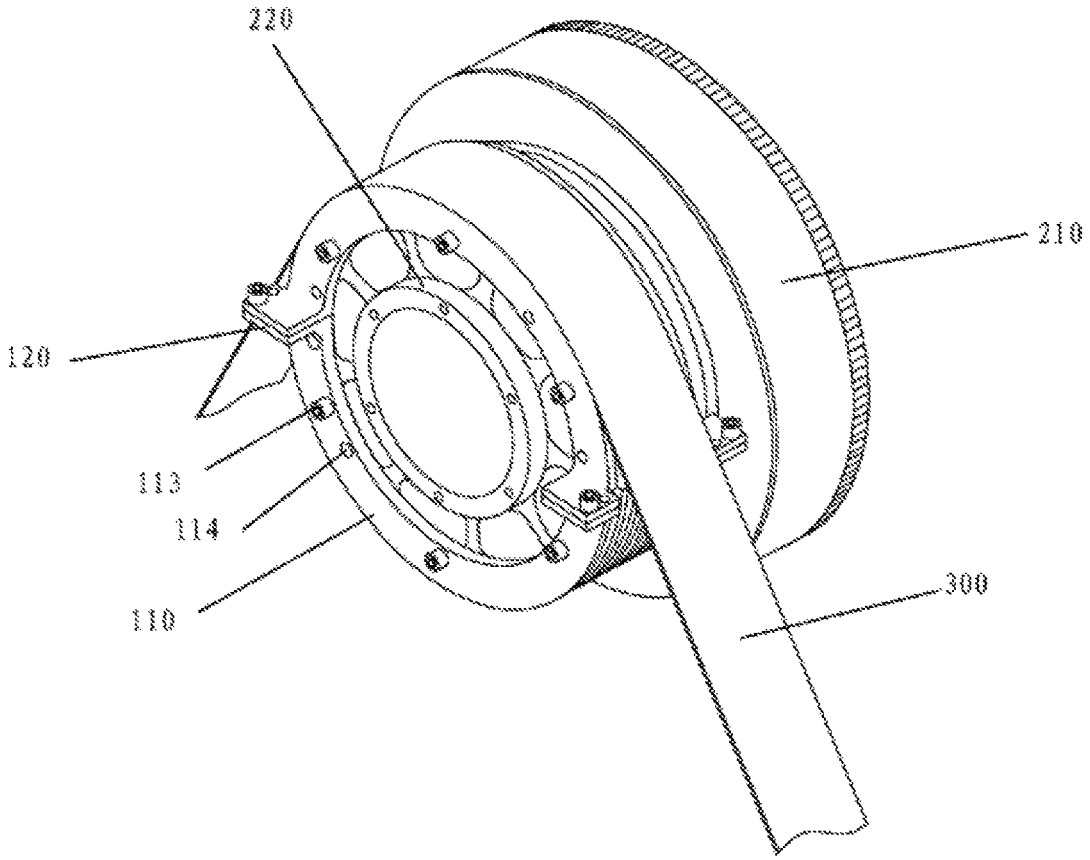
FIG. 4 is a schematic diagram of a first replacement process of a traction sheave section of a pulley component according to an embodiment of the present utility model.
Figure 5:
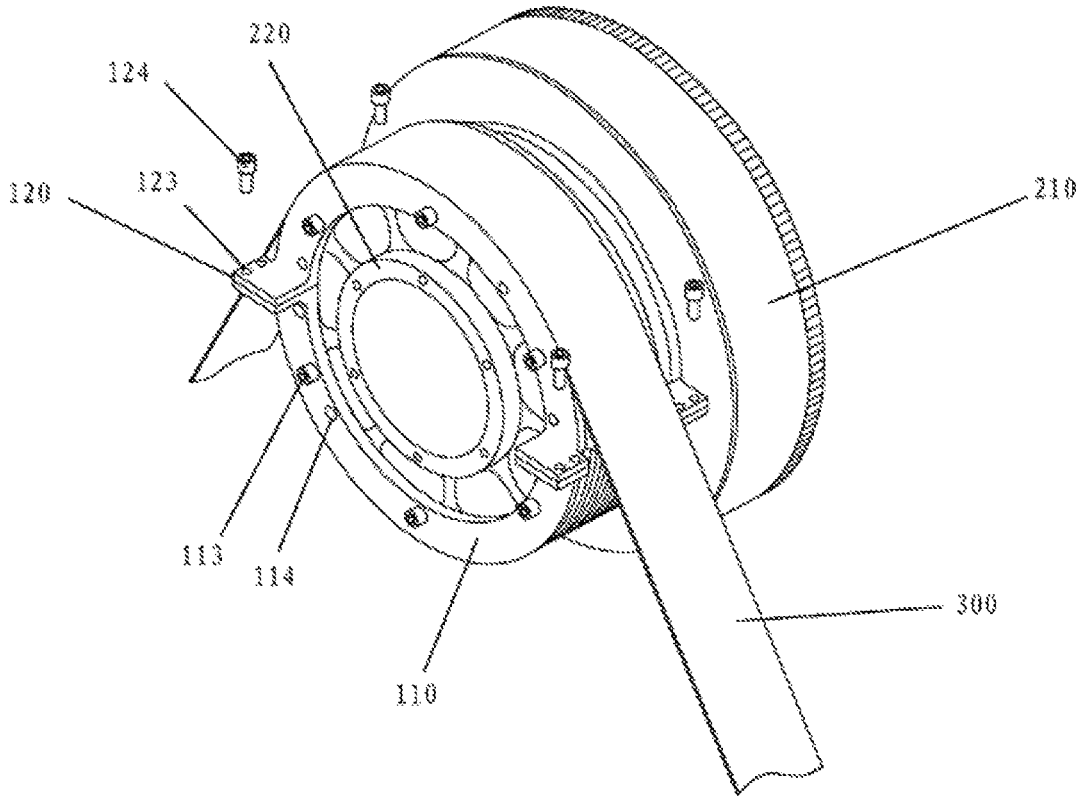
FIG. 5 is a schematic diagram of a second replacement process of a traction sheave section of a pulley component according to an embodiment of the present utility model.
Figure 6:
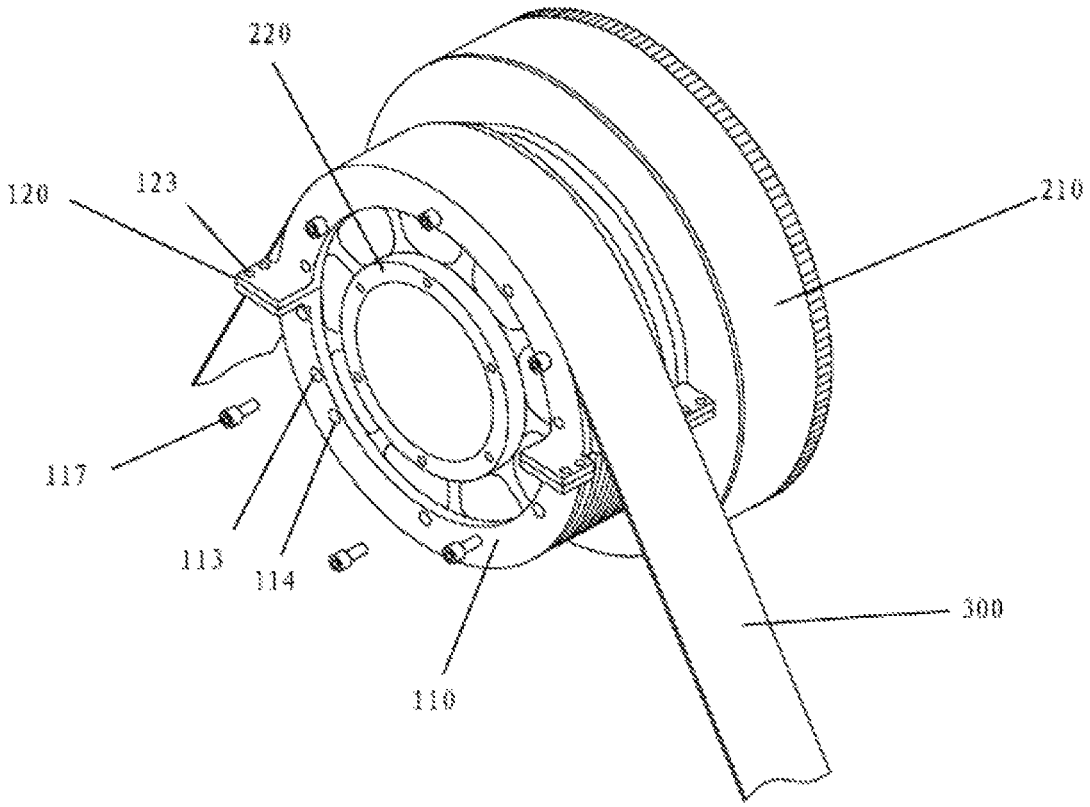
FIG. 6 is a schematic diagram of a third replacement process of a traction sheave section of a pulley component according to an embodiment of the present utility model.
Figure 7:
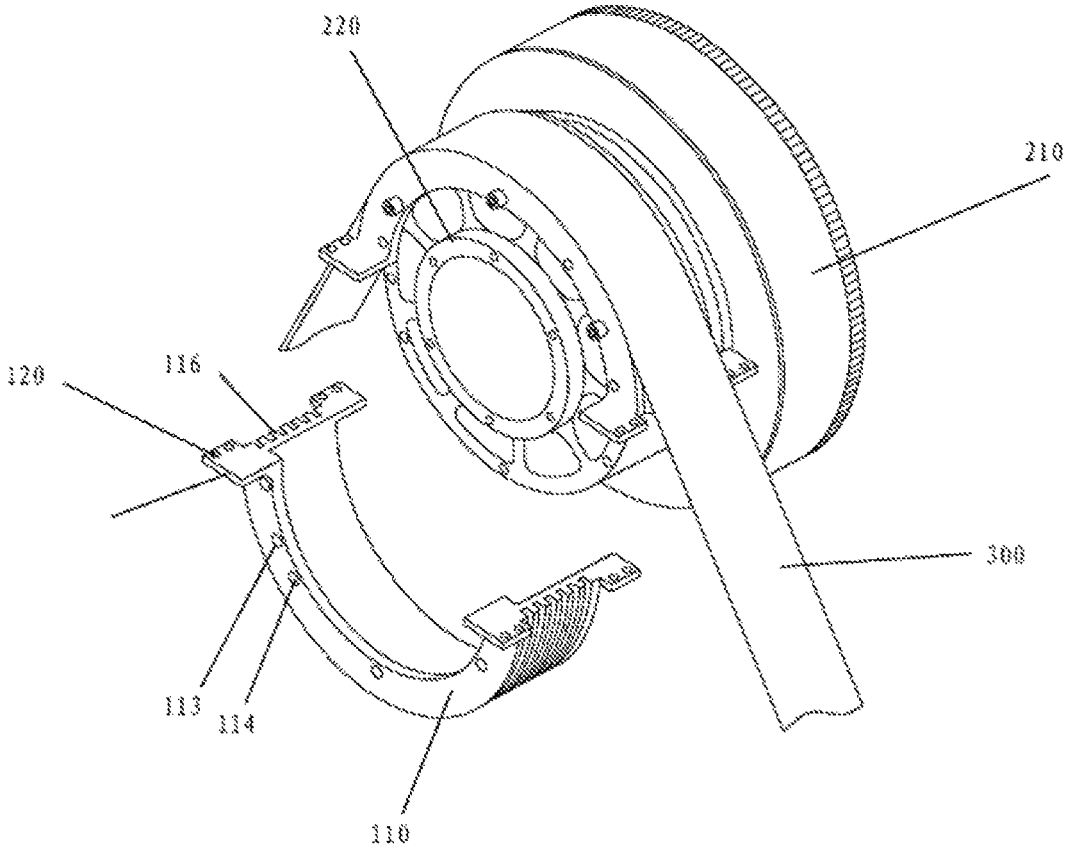
FIG. 7 is a schematic diagram of a fourth replacement process of a traction sheave section of a pulley component according to an embodiment of the present utility model.

A working process of replacing a worn traction sheave section for the pulley component of the present utility model is described below with reference to FIG. 4 to FIG. 7. First, as shown in FIG. 4, the traction sheave section 110 is rotated to the separate location where the traction sheave section 110 leaves the conveyor belt 300. In this case, no friction or collision occurs between the traction sheave section 110 and the conveyor belt. Subsequently, as shown in FIG. 5, several first connecting bolts 124 are respectively removed from the first connecting hole 123 on the connecting lug 120, so that securement between the traction sheave section 110 and another traction sheave section is released. Next, as shown in FIG. 6, the several second connecting bolts 117 are respectively removed from the second connecting holes 113 on the traction sheave section 110, so that securement between this traction sheave section 110 and the pulley body 210 is released. An order of operations that are shown in FIG. 5 and FIG. 6 may be changed, which does not affect a maintenance process of the traction sheave of the present utility model. Finally, as shown in FIG. 7, after axial-direction securement and circumferential-direction securement of the traction sheave section 110 are released, the traction sheave section 110 can be removed, and replaced with a new traction sheave section. In this way, a process of replacing a traction sheave section is completed. If another transfer section further needs to be replaced, only a corresponding traction sheave section needs to be rotated to a separate location, and steps shown in FIG. 4 to FIG. 7 are repeated.

In an aspect, because in a replacement process, a conveyor belt does not need to be pulled away or removed, a time of replacing a part is greatly reduced, and an amount of work of a maintenance person is reduced. In another aspect, a traction sheave part that needs to be replaced may be determined according to a wear condition, so that as compared with replacement of an entire traction sheave, replacement of a traction sheave section has a lower cost of parts, and at the same time, the entire traction sheave can have reliable performance same as that in the prior art.

It should be known that only a process of replacing a traction sheave that has two traction sheave sections is described above with reference to FIG. 4 to FIG. 7. However, with reference to the description herein, a person skilled in the art may also know how to operate and replace a traction sheave that has multiple traction sheave sections, and details are no longer described herein.

The present utility model further provides an elevator. The traction sheave or the pulley component having the same that is described above is applied in the elevator. Therefore, in a process of maintaining the elevator, a time for maintenance or part replacement can be greatly reduced, costs of human and material resources and time can be reduced, and it can also be avoided that a user waits long and becomes impatient.

In the description of the present utility model, it needs to be understood that orientation or location relationships indicated by "up", "down", "front", "rear", "left", and "right" are based on orientation or location relationships shown in the accompanying drawings, and are only used to facilitate description of the present utility model and simplify description, but are not used to indicate or imply that the apparatuses or features must have specific orientations or are constructed and operated by using specific orientations, and therefore, cannot be understood as a limit to the present utility model.

The traction sheave and the pulley component and the elevator that have the same according to the present utility model are mainly described in the foregoing example. Although only some implementation manners of the present utility model are described, a person of ordinary skill in the art should understand that the present utility model may be implemented in multiple other forms without departing from the subject matter and scope of the present utility model. Therefore, the presented examples and implementation manners are regarded to be illustrative rather than limitative, and the present utility model may cover various changes and replacements without departing from the spirit and scope of the present utility model that are defined by the appended claims.

The invention claimed is:

1. A traction sheave, comprising:

a traction sheave body, formed of several arc-shaped traction sheave sections that are connected to each other; and connecting portions, disposed at two ends of each traction sheave section along a lateral surface of the traction sheave section, wherein the connecting portions at the two ends of each traction sheave section fit each other.

2. The traction sheave according to claim 1, wherein a quantity of the traction sheave sections is 2.

3. The traction sheave according to claim 2, wherein an angle of any one of the traction sheave sections is greater than a first angle, and the first angle is between 147° and 165°.

4. The traction sheave according to claim 2, wherein angles of the two traction sheave sections are the same.

5. The traction sheave according to claim 2, wherein an outer-circumferential perimeter of any one of the traction sheave sections is greater than a first length, and a ratio of the first length to a total perimeter of the traction sheave is between 0.4 and 0.46.

6. The traction sheave according to claim 1, wherein a quantity of the traction sheave sections is greater than 2.

7. The traction sheave according to claim 6, wherein an angle of any one of the traction sheave sections is less than a second angle, and the second angle is between 195° and 213°.

8. The traction sheave according to claim 6, wherein an outer-circumferential perimeter of any one of the traction sheave sections is less than a second length, and a ratio of the second length to a total perimeter of the traction sheave is between 0.54 and 0.6.

9. The traction sheave according to claim 6, wherein each traction sheave section has a same angle.

10. The traction sheave according to claim 1, wherein the connecting portions are connecting lugs, and the connecting lugs extend perpendicular to the lateral surface of the traction sheave section.

11. The traction sheave according to claim 10, wherein a first end of the connecting lug extends to an inner circumference of the traction sheave section, and a second end of the connecting lug extends from an outer circumference of the traction sheave section.

12. The traction sheave according to claim 11, wherein a first connecting hole is provided at the second end of the connecting lug, and each traction sheave section is connected respectively by using a fastener passing through the first connecting hole of each connecting lug.

13. The traction sheave according to claim 1, wherein several second connecting holes and/or positioning holes are disposed in a circumferential direction on the lateral surface of each traction sheave section.

14. The traction sheave according to claim 13, wherein the several second connecting holes and/or positioning holes are uniformly disposed in a circumferential direction on the lateral surface of each traction sheave section.

15. A pulley component, comprising:

the traction sheave according to claim 1;

a pulley, comprising a pulley body and a shaft located on a side of the pulley body, the traction sheave being sleeved over the shaft of the pulley; and a conveyor belt, tensioned with a part of the traction sheave.

16. The pulley component according to claim 15, wherein the traction sheave section and the conveyor belt have a contact location and a separate location, and at the separate location, the traction sheave section is detachable.

17. The pulley component according to claim 15, wherein the conveyor belt forms a wrap angle relative to the traction sheave, and an angle of any one of the traction sheave sections is less than a difference value between 360° and a value of the wrap angle.

18. The pulley component according to claim 17, wherein the wrap angle is between 147° and 165°.

19. The pulley component according to claim 15, wherein a lateral surface of the traction sheave is fixedly connected to a lateral surface of the pulley body by using a fastener.

20. An elevator, comprising: the pulley component according to claim 15.

21. A traction sheave, comprising:

a traction sheave body, formed of several arc-shaped traction sheave sections that are connected to each other; and connecting portions, disposed at two ends of each traction sheave section along a lateral surface of the traction sheave section, wherein the connecting portions at the two ends of each traction sheave section fit each other;

wherein the connecting portions are connecting lugs, and the connecting lugs extend perpendicular to the lateral surface of the traction sheave section;

wherein the connecting lugs are respectively disposed on two lateral surfaces of the traction sheave section.

22. A traction sheave, comprising:

a traction sheave body, formed of several arc-shaped traction sheave sections that are connected to each other; and connecting portions, disposed at two ends of each traction sheave section along a lateral surface of the traction sheave section, wherein the connecting portions at the two ends of each traction sheave section fit each other;

wherein a boss is disposed along an inner circumference of each traction sheave section, and several second connecting holes and/or positioning holes are disposed in a circumferential direction on a lateral surface of the boss.

23. The traction sheave according to claim 22, wherein the several second connecting holes and/or positioning holes are uniformly disposed in a circumferential direction on the lateral surface of each boss.

* * * * *